United States Patent [19]

Childers et al.

[11] Patent Number: 4,557,282

[45] Date of Patent: Dec. 10, 1985

[54] COIN-SORTING WHEEL AND COUNTER FOR HIGH-SPEED COIN-SORTING AND COUNTING APPARATUS

[75] Inventors: Roger K. Childers, Tigard; Kenneth L. Buchanan, Troutdale; Andrew L. Trumbo, Beaverton, all of Oreg.

[73] Assignee: Childers Corporation, Wilsonville, Oreg.

[21] Appl. No.: 526,421

[22] Filed: Aug. 25, 1983

[51] Int. Cl.[4] ..... G07D 3/00

[52] U.S. Cl. ..... 133/3 A; 133/3 H; 133/8 R

[58] Field of Search ..... 133/3 R, 3 A, 3 B, 3 C, 133/3 D, 3 E, 3 F, 3 G, 3 H, 8 R, 8 A; 221/241, 277

[56] References Cited

U.S. PATENT DOCUMENTS

| | | | |
|---|---|---|---|
| 2,348,936 | 10/1940 | Sprenger | 133/3 R |
| 2,906,276 | 9/1959 | Blanchette et al. | 133/3 R |
| 2,977,961 | 4/1961 | Buchholz et al. | 133/3 R |
| 3,795,252 | 3/1974 | Black | 133/3 A |
| 3,998,237 | 12/1976 | Kressin et al. | 133/3 A |
| 4,086,928 | 5/1978 | Ristvedt et al. | 133/3 A |
| 4,098,280 | 7/1978 | Ristvedt et al. | 133/3 A |
| 4,111,216 | 9/1978 | Brisebarre | 133/3 A |
| 4,234,003 | 11/1980 | Ristvedt et al. | 133/3 A |

*Primary Examiner*—F. J. Bartuska

*Attorney, Agent, or Firm*—Seed & Berry

[57] ABSTRACT

A coin-engaging apparatus for use with a coin-sorting machine having a rotating flexible surface, comprising: a cylindrical shaft positionable within a generally horizontally oriented cylindrical opening of the machine sized to receive the shaft therein, the opening having an open end and a closed end, the shaft being rotatably and horizontally positionable within the opening, the shaft having an eccentric, longitudinal, threaded first bore at an end positionable toward the open end of the opening, and having a longitudinal, threaded second bore at another end positionable toward the closed end of the opening; a coin-depressing wheel rotatably mounted along its axis of rotation on a shoulder screw, the screw being threadedly engageable by the eccentric first bore for positioning the wheel above the surface; a spacer screw threadedly engageable by the threaded second bore and adjustably extendable therefrom for butting against the closed end of said opening; and a locking screw for locking the shaft in a selected rotational position within the opening. The coin-depressing wheel has two oppositely disposed, substantially flat sidewalls to provide a reversible wheel.

29 Claims, 6 Drawing Figures

FIG. 1
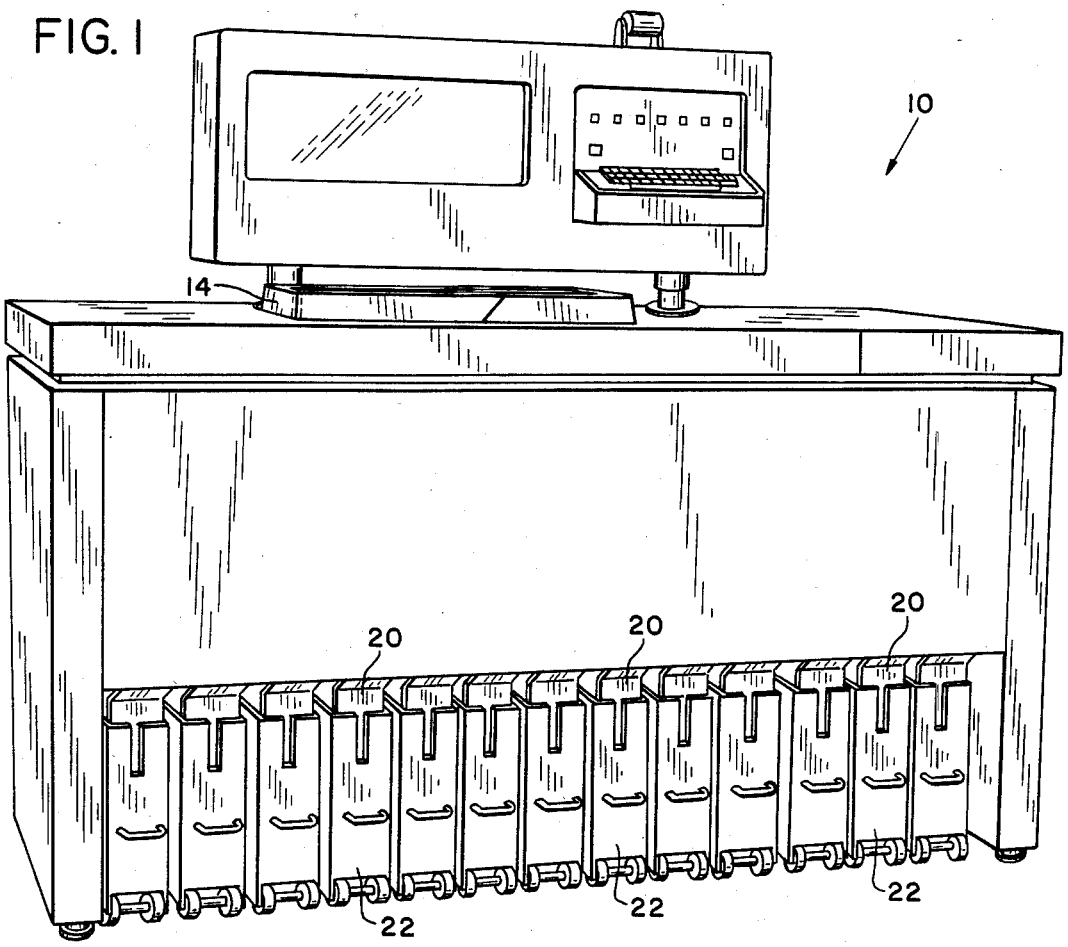
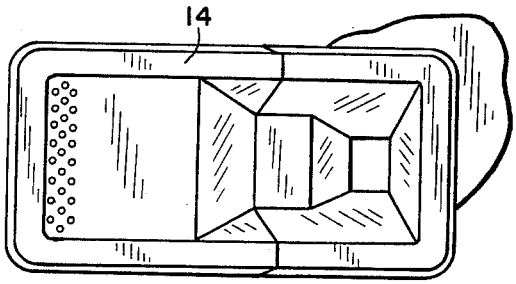
FIG. 2
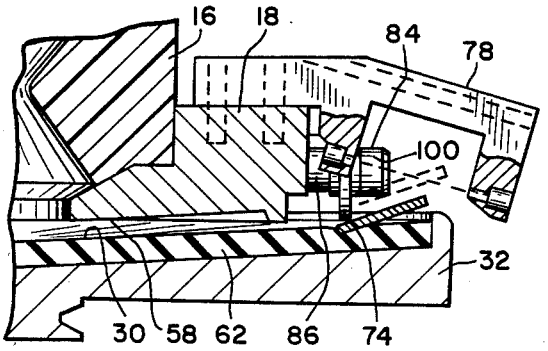
FIG. 5

COIN-SORTING WHEEL AND COUNTER FOR HIGH-SPEED COIN-SORTING AND COUNTING APPARATUS

DESCRIPTION

1. Technical Field

This invention relates to coin-sorting and counting apparatus, and more particularly, to coin-sorting wheels and counter arrangement for sorting and counting coins carried on a rotating disc.

2. Background Art

The large and increasing volume of coin-operated machines makes the rapid and accurate sorting and counting of coins an economic necessity. Vending machines, metropolitan area transit systems, pay telephones, and other coin-operated devices have expanded the use of coins and the requirements for economical counting of coins beyond all expectations.

Several machines have been designed for this purpose, exemplified by those disclosed in U.S. Pat. Nos. 2,906,276 (to Blanchette et al.), 3,795,252 (to Black), 4,086,928 (to Ristvedt et al.), and 4,111,216 (to Brisebarre). Each has coin-sorting by centrifugal force according to denomination, counting of the individual denominations by some type of sensing means, and storing and display of the information about the counts during the process. Each also provides for storing and removal of the coins after counting.

In such machines, the centrifugal force is imparted to the coins by the rotation of a disc onto which coins are delivered in bulk, usually through a central hopper. The coins are then guided by a coin-queueing head to deliver them in a queue to a position adjacent a peripheral retaining rim of the disc. At the peripheral rim, the coins are selectively engaged according to denomination by one of a plurality of coin-engagement means such as wheels, blades, cams or the like positioned around the peripheral rim. The coin-engagement means depresses or lifts the coins to free them from the peripheral rim of the disc and allow the centrifugal force to hurl them through the air a distance to one of a plurality of corresponding catching devices. The coins are then diverted to appropriate collecting bags. The sorting is typically accomplished by the coin-engagement means based upon the differences in diameter of the various denominations of coins being processed. Conventional coin-engagement means require the coins to be in a single-layer, single-file row at the peripheral rim to avoid malfunctioning of the machine and to insure a proper count. The count is usually made by photoelectric means which sense the number of coins entering each catching device as the coins reach the catching device. The photoelectric means counts the coins by measuring the number of times a produced beam of light extending across the flight path of the coins is broken.

A coin-engagement means which has proven particularly successful is a wheel rotatably mounted on a fixed shaft. The wheel is positioned above the path of travel of the queue, and the rim of the wheel engages each coin individially and depresses the radially inner edge of the coin into a flexible pad covering the disc. This action raises the radially outward edge of the coin above the peripheral rim and the centrifugal force hurls the coin over the rim to one of the catching devices.

The wheels are mounted at spaced intervals along the path of travel of the queue and positioned at preselected distances radially inward of the peripheral rim of the disc at which the queue is formed. The largest diameter coins are sorted first by a wheel positioned a distance away from the peripheral rim which causes the wheel to engage the upper surface of the coin adjacent to its radially inward edge. Spaced therefrom is another wheel correspondingly positioned inward of the rim along the queue path by a lesser distance to engage the next smaller diameter coins. In like fashion additional wheels are positioned to engage coins of each successively smaller diameter. Smaller diameter coins pass unaffected by any wheel positioned for engagement of a larger diameter coin since they are at a distance from the peripheral rim more than the diameter of the smaller coin.

In addition to this radial positioning, the wheels are positioned at preselected distances above the flexible pad. The distance depends on the thickness of the coin to be engaged by a particular wheel, since the coin need only be pressed into the flexible pad by an amount sufficient to raise the radially outward edge of the coin above the peripheral rim. Insufficient depressing of a coin results in it not being hurled from the disc, and over pressing places unnecessary drag on the rotating disc and increases wheel wear.

To make the machine easily adaptable for use with various denominational combinations of coins and various countries' coinage, the wheels should be adjustable radially and vertically over a wide range of positions, which has not been possible in the past. It would be beneficial if a single design wheel assembly could be used for all requirements. In any event, for optimum operation of the machine, particularly when operating at high speeds, the wheels must be finely set or tuned for the particular coin-queueing head being used on the machine, and the wheels must be re-tuned periodically to compensate for head and wheel wear, and changes in the alignment of the head on the disc. In the past, such fine adjustments have been difficult and time consuming to make. Furthermore, in the past, when the wheels wore significantly, the wheel had to be discarded and replaced with a new wheel. This required consuming disassembly of the machine, and installation and tuning of the new wheel.

Another problem encountered with such machines involves obtaining correct counts of the coins processed by the machine. Because the disc labors under varying loads and partial blocking conditions during its normal operation, the speed of rotation of the disc temporarily slow down and speed up accordingly. These fluctuations in rotational speed occur frequently during operation of the machine and cause the disc to hurl successive coins from the disc at different linear speeds. This is because the centrifugal force imparted to the coins varies depending on the rotational speed of the disc. As a result, the travel of one coin of a particular denomination from the coin-engagement means over the distance to the catching device, whereat the coin is counted, may occur at a different speed and take longer than the travel of the next coin of that denomination sorted. Consequently, the subsequent coin may hit, catch up with or even overtake the first coin. In addition to the problems which may occur when two coins collide, if the coins are travelling in the vicinity of each other as they pass by the light beam of the photoelectric means used to count the coins, the pair of coins may be counted only once, producing an erroneous count.

Yet another problem with such machines involves design and positioning of the catching devices. Unless a smooth and predictable flight path is achieved, the coins hurled from the disc are sprayed at over a wide range of paths, making it difficult to catch all coins and increasing interference resulting from coins ricocheting within the coin catching device once caught.

It will therefore be appreciated that there has been a significant need for a coin-sorting wheel which is inexpensive in construction, easily adjusted both radially and vertically, and quick to replace. The wheel should have prolonged wheel wear. The counter arrangement used to count coins sorted by the wheel should prevent miscounts resulting from the disc operating at varying rotational speeds. The present invention fulfills this need, and further provides other related advantages.

DISCLOSURE OF INVENTION

The present invention resides in a coin-engaging apparatus for use with a coin-sorting machine having a rotatable flexible surface, comprising: a support member mountable within a generally horizontally oriented receiver of the machine, the support member being rotatably and horizontally positionable within the receiver, the support member rotatably supporting a coin-engaging wheel for rotation about an axis eccentric with the support member, the coin-engaging wheel being positionable above the surface for engaging coins carried thereon; and means for lockably retaining the position of the support member within the receiver during operation of the machine.

More specifically, the support member has a longitudinal, selectively extendable member projectable from an end of the support member mountable within the receiver for engaging an internal end wall of the receiver for adjustably setting the limit of horizontally inward movement of the support member in the receiver. The extendable member is threaded to threadably engage threads of the support member. The support member also has a first shaft positionable within the receiver with an eccentric second shaft extending from one end of the first shaft for rotatably supporting the coin-engaging wheel. The second shaft is detachable from the first shaft for removal of the coin-engaging wheel. In the presently preferred embodiment of the invention, the second shaft is a threaded shoulder screw having a circumferential bearing surface for rotatably supporting the coin-engaging wheel.

The coin-engaging wheel has at least one substantially flat sidewall extending to a coin-contacting circumferential sidewall, with the sidewall being positionable toward the coin being engaged. To prolong the operating life of the coin-engaging wheel, the wheel has two oppositely disposed substantially flat sidewalls to allow a reversing of the wheel. The coin-engaging wheel also includes a hub rotatably supportable by the first member, and the two oppositely disposed sidewalls are symmetrically positioned along the hub. The two oppositely disposed sidewalls terminal radially outward of the axis of rotation of the coin-engaging wheel to define a coin-contacting edgewall therebetween, the edgewall having substantially square edges. A coin counting means is positioned adjacent to each of the coin-engaging means for counting coins as they are sorted by the coin-engaging means.

In the presently preferred embodiment, a cylindrical shaft is positionable within a generally horizontally oriented cylindrical opening of the machine sized to receive the shaft therein. The opening has an open and a closed end, and the shaft is rotatably and horizontally positionable within the opening. The shaft has an eccentric, longitudinal threaded first bore at an end positionable toward the open end of the opening, and has a longitudinal threaded second bore at another end positionable toward the closed end of said opening. The coin-engaging wheel is rotatably mounted along its axis of rotation on a threaded first member, the first member being threadedly engageable by the eccentric first bore for positioning the wheel above the surface. A threaded second member is threadedly engageable by the threaded second bore and adjustably extendable from the second bore for engaging the closed end of the opening.

As discussed above, means are provided for locking the shaft in a selected rotational position within the opening, whereby adjustment of the second member adjusts the horizontal position of the wheel relative to the surface and adjustment of the rotational position of the shaft within the opening adjusts the vertical position of the wheel relative to the surface.

Other features and advantages of the invention will become apparent from the following detailed description taken in conjunction with the accompanying drawings.

BRIEF DESCRIPTION OF THE DRAWINGS

FIG. 1 is an isometric frontal view of a coin-sorting and counting apparatus embodying the improved coin-sorting wheel and counter arrangement of the present invention;

FIG. 2 is an enlarged, fragmentary top plan view of the coin loading tray of the apparatus shown in FIG. 1;

FIG. 5 is an enlarged, fragmentary, sectional view taken substantially along the line 5—5 of FIG. 3, showing a coin being engaged by a coin-sorting wheel.

BEST MODE FOR CARRYING OUT THE INVENTION

Figures 4, 6:
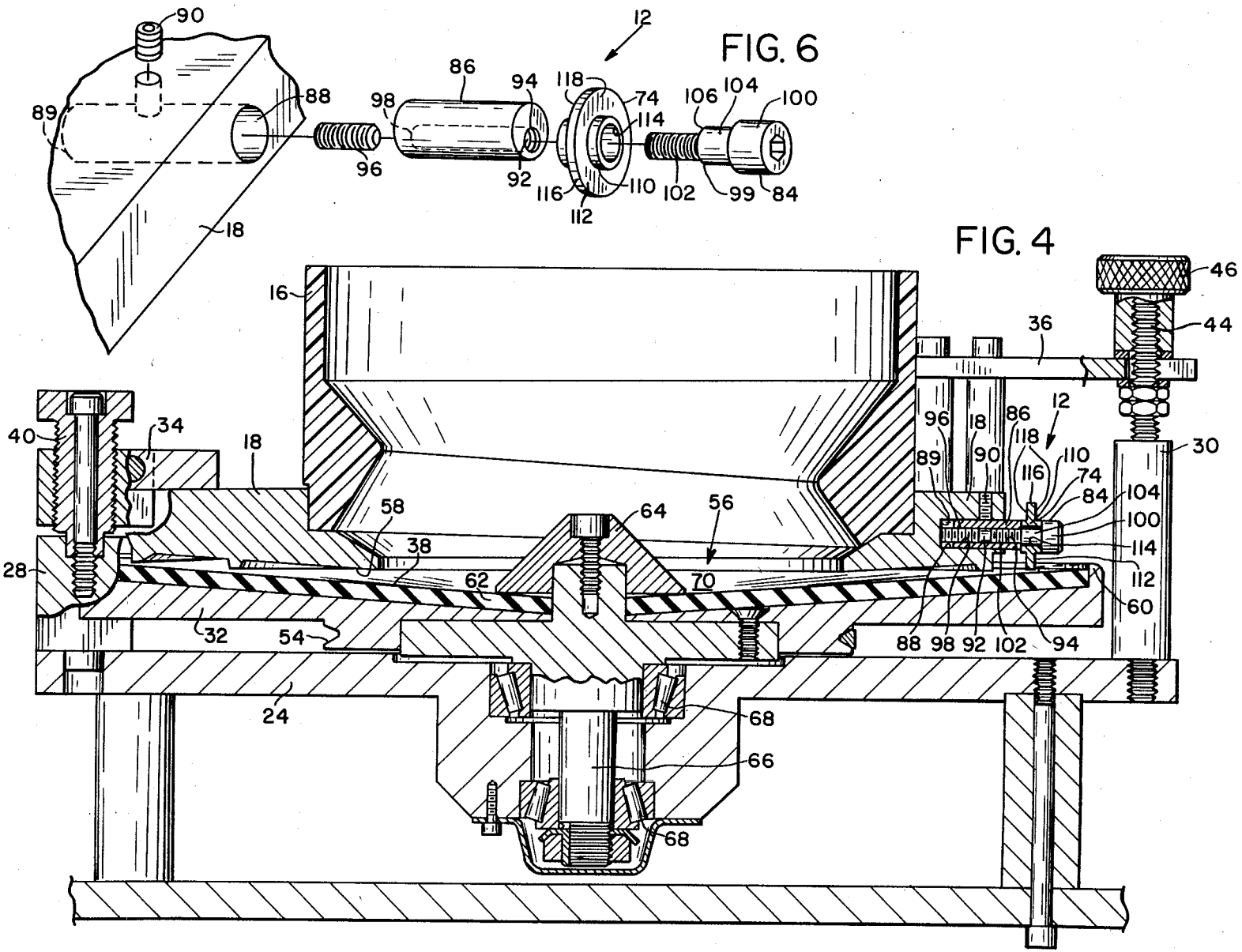
FIG. 4 is an enlarged, sectional view taken substantially along the line 4—4 of FIG. 3.
FIG. 6 is an enlarged isometric, exploded view of a coin-sorting wheel assembly of the present invention.

As shown in the drawings for purposes of illustration, the present invention is embodied in a high-speed coin-sorting and counting apparatus, indicated by reference numeral 10. More specifically, the present invention is embodied in an improved coin-sorting wheel assembly 12 and counter arrangement for such an apparatus. Referring to FIGS. 1, 2, and 4, an undifferentiated mix of coins with random orientation is poured into a loading tray 14 of the apparatus 10 and moves therefrom into a hopper 16 located beneath the tray and immediately above a queueing head 18. The queueing head 18, in conjunction with the coin-sorting wheel assembly 12 and other parts of the apparatus 10, operates to separate, sort, count and distribute the coins into a plurality of coin bags 20 which are each mounted in one of a plurality of coin-bag-holding receptacles 22, of which there are at least two for each denomination of coin. In the presently preferred embodiment of the invention, when designed to handle U.S. coinage, the apparatus processes simultaneously pennies, nickels, dimes, quarters, half-dollars, and Susan B. Anthony dollar denomination coins.

Figure 3:
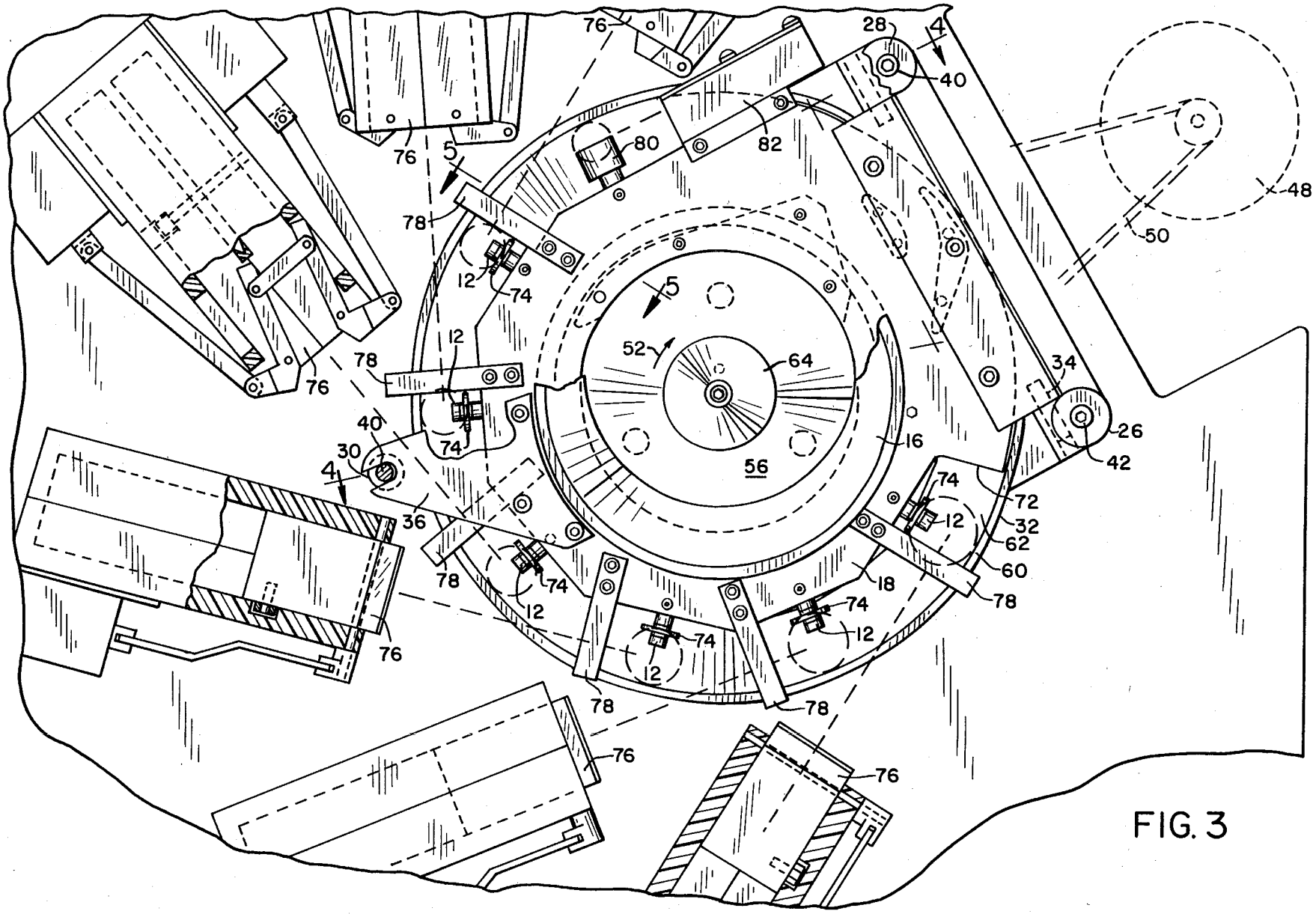
FIG. 3 is a top plan view of the coin-sorting wheels and counter arrangement of the present invention shown positioned around a coin-queueing head and above a rotatable disc with a coin shown in phantom line positioned under each coin-sorting wheel.

As shown in FIGS. 3 and 4, the apparatus 10 includes a stationary support base 24 which has three upright supports 26, 28 and 30 attached thereto and which supports a rotatable, circular disc 32. The queueing head 18 is attached by a hinge 34 to two of the upright supports 26 and 28 and by a flange 36 to the upright support 30 for holding the head in position above an upper surface 38 of the disc 32 by approximately the thickness of the thickest coin to be processed by the apparatus 10. The precise vertical position of the head 18 above the upper surface 38 is adjustable through adjustment bolts 40, 42 and 44, which hold the hinge 34 and the flange 36 to the upright supports 26, 28 and 30. The hinge 34 permits easy lifting of the head 18 away from the disc 32 for inspection cleaning and clearing of any jams or obstructions which may occur. The bolt 44 includes a thumb-operated cap 46 which may be readily unscrewed to permit the head 18 to be moved about the hinge 34. As shown in FIG. 3 by phantom lines, a motor 48 drives the disc 32 through a belt 50 to rotate it in a clockwise direction indicated by arrow 52 when viewed from above. The belt 50 rides on a pulley 54 formed as an integral part of the disc 32. The rotation of the disc 32 imparts a centrifugal force to the coins being processed.

The hopper 16 is rigidly attached to and supported above the queueing head 18, and has a cork screw interior shape. The coins moved into the hopper 16 are funneled into a central circular opening 56 in the head. A lower surface or face 58 of the head 18 faces toward the upper surface 38 of the rotating disc 32 and is tapered upwardly from the central opening 56 to its outer perimeter at an angle of approximately four degrees. The taper of the lower surface 58 of the head 18 conforms with the taper on the upper surface 38 of the disc 32. The taper is provided to facilitate holding coins down on the upper surface 38 of the disc 32, particularly when they reach a peripheral rim 60 of the disc. A resilient frictional pad 62 covers the disc 32 and defines the upper surface 38 of the disc. The lower surface 58 of the head 18 is a low-friction surface, preferably made of a durable metal. A conical member 64 is fixedly attached to the disc 32, at its center, below the central opening 56, to prevent coins from remaining in the center of the disc by their avoiding the centrifugal force caused by rotation of the disc. The centrifugal force is necessary to move the coins from the central opening 56 to the peripheral rim 60. The disc 32 is rotatably mounted to the base 24 by a shaft 66 supported by a pair of frictionless roller bearings 68.

As the coins come through the central circular opening 56 of the head 18 they enter a loading area 70 and encounter the centrifugal force generated by the rotating upper surface 38 of the disc 32. The centrifugal force is imparted to the coins by their contact with the resilient frictional pad 62. Consequently, the coins tend to move in a spiral direction away from the loading area 70 and into the space between the lower surface 58 of the head 18 and the upper surface 38 of the disc 32. While the coins travel between the stationary head 18 and the rotating disc 32 under the urging of the centrifugal force, they are guided and separated to place them in a non-stacked, single-file flow or queue by the time they reach an exit passage 72 of the head 18 positioned adjacent to the peripheral rim 60. Thereafter, coin-sorting wheels 74 of the coin-sorting wheel assemblies 12, as will be described in more detail below, sort the coins one at a time.

The coins leave the head 18 through the exit passage 72 under the influence of the rotating disc 32, whereupon they are free of any control by the head. The disc 32 then carries the coins in the queue which is positioned adjacent to the peripheral rim 60 of the disc to a number of the coin-sorting wheel assemblies 12 for sorting by denomination. The coin-sorting wheel assemblies 12 are mounted to the head 18 and spaced along the outer perimeter of the head. The coin-sorting wheels 74 of the coin-sorting wheel assemblies 12 extend from the head radially by varying distances corresponding to the diameter of the coin to be depressed, with the largest diameter coin being sorted first, then the next largest, and so on. For United States coinage, the apparatus 10 includes six coin-sorting wheel assemblies 12 and will process and sort six denominations of coins in the same batch, i.e., penny, nickel, dime, quarter, half-dollar, and Susan B. Anthony dollar coins. As shown in FIG. 5, the coin-sorting wheel 74 depresses the inner edge of a coin into the resilient pad 62 causing the outer edge to raise and be hurled over the peripheral rim 60 of the disc 32 by the centrifugal force into a coin catching device 76. The coins are counted by an electro-optical sensor or photoelectric cell 78 as the coins are travelling through the air. One catching device 76 is positioned across from each sorting wheel 74. Should for some reason a coin not be hurled from the disc 32 a last wheel 80 (see FIG. 3) is provided with a rim width size sufficient to engage all diameter coins being processed and cause the coin to be sufficiently pressed into the resilient pad 62 and bounced upwardly therefrom by the resiliency of the pad that the centrifugal force will hurl it off the disc 32 into a chute 82 which diverts the coin into a special holding compartment (not shown).

As best shown in FIGS. 4 and 6, the coin-sorting wheel assembly 12 includes one of the coin-sorting wheels 74 rotatably attached along its central rotational axis by a shoulder screw 84 to an elongated cylindrical shaft 86. The coin-sorting assembly 12 is mounted to the head 18 by insertion of the shaft 86 into a radially oriented end-capped cylindrical bore 88 with an inward blocked end 89 provided in the head along its outer perimeter. The end-capped bore 88 has a diameter sized to receive the shaft 86 therein and a depth sufficient to permit full insertion of the shaft to place the coin-sorting wheel 74 in proper radial alignment above the largest diameter coin to be processed by the apparatus 10. A lock screw 90 locks the shaft 86 in place within the end-capped bore 88.

The shaft 86 has an eccentric, interiorly threaded longitudinal hole 92 extending fully therethrough which is sized to threadedly receive the shoulder screw 84 in an outwardly facing end 94 of the through-hole and an adjustable spacer or set screw 96 in an inwardly facing end 98 of the through-hole. Adjustment of the distance the spacer screw 94 protrudes from the inwardly facing end 98 of the through-hole 92 determines the radial positioning of the coin-sorting wheel 74 when the shaft 86 is inserted into the end-capped bore 88 sufficiently to butt the spacer screw against the blocked end 89 of the bore. Consequently, radial adjustment of the coin-sorting wheel 74 may be accomplished merely by loosening the lock screw 90, removing the shaft 86 from the end-capped bore 88, turning the spacer screw 96 in or out by an amount corresponding to the desired radial adjustment of the coin-sorting wheel, and then replacing and locking the shaft in the end-capped bore.

The shoulder screw 84 has an elongated shaft 99 with a head 100 at one end. An opposite end portion 102 of the screw 84 has exterior threads sized to threadably engage the interior threads of the through-hole 92. Extending between the head 100 and the threaded end portion 102 of the screw 84 is a bearing surface 104 on which the coin-sorting wheel 74 rotates freely. The bearing surface 104 has a larger diameter than the threaded end portion 102 to define a shoulder 106 which limits the inward travel of the screw into the through-hole 92. The threads of the through-hole 92 and the threaded end portion 102 of the screw 84 are threaded in a direction which results in the tightening of the screw in the through-hole as a result of any frictional forces between the coin-sorting wheel 74 and the bearing surface 104 resulting from rotation of the wheel during operation of the apparatus 10. The bearing surface 104 has a smaller diameter than the shaft 86, with the longitudinal travel of the coin-sorting wheel 74 on the bearing surface 104 being inwardly limited by the end wall of the shaft 86 and outwardly limited by the head 100.

Vertical adjustment of the coin-sorting wheel 74 is accomplished by rotation of the shaft 86 within the end-capped bore 88. Because of the eccentricity of the through-hole 92, relative to the central longitudinal axis of the shaft 86, and the shoulder screw 84 attaching the coin-sorting wheel 74 to the shaft, rotation of the shaft raises and lowers with cam-like movement the height of the coin-sorting wheel 74 above the resilient pad 62. As with radial adjustments of the coin-sorting wheel 74, the lock screw 90 must be first loosened and then retightened to lock the shaft 86 in its selected rotational position in the end-capped bore 88.

By providing such means for adjusting the position of the coin-sorting wheels 74, one standardized coin-sorting wheel assembly 12 having a standardized coin-sorting wheel 74 can be used for sorting all denominations of coins and coinage of various countries, and it is not necessary to manufacture new wheel assemblies for each denomination or each country. This reduces design and manufacturing costs and delays, and inventory problems. Furthermore, the coin-sorting assemblies 12 of the present invention permit accurate, easy and rapid initial set up adjustments of the coin-sorting wheels 74 and subsequent fine tuning of the wheels. The simple construction also allows for easy replacement of worn coin-sorting assemblies 12 or wheels 74.

The coin-sorting wheel 74 itself has a novel design with a central elongated hub 110 defining the central rotational axis of the wheel, and a circular wheel disc 112 extending radially outward from the longitudinal center of the hub transverse to the rotational axis. The hub 110 has a longitudinally extending interior bearing wall 114 sized to ride on the bearing surface 104 of the shoulder screw 84 to allow the wheel to freely rotate under the rotational force applied to the wheel as it engages a coin. The coin-sorting wheel 74 has a peripheral rim or edge wall 116 which contacts the coin's upper surface when the wheel engages the coin to depress it into the resilient pad 62 for hurling from the rotating disc 32.

Wear along the peripheral rim 116 of the wheel disc 112 usually occurs only along its outer edge which is squared for best interaction with the coins. The wheel disc 112 of the present invention is provided with symmetrical sides 118 to allow reversal of the coin-sorting wheel 74 on the shoulder screw 84 should the outer edge of the wheel disc become worn and rounded from use, to present a new square outer edge to the coins. In such fashion, the useful life of the wheel discs 112 is effectively doubled.

To eliminate the problem of collision and miscounting of coins which are hurled off the rotating disc 32 by the coin-sorting wheels 74 at different speeds because of variations in the rotational speed of the disc during operation, causing two coins to be in the same vicinity as they travel through the air, in the present invention, the sensors 78 which count the coins are located adjacent to their corresponding coin-sorting assembly 12 with their light beams across the flight path of the coins therefrom. Since the coin-sorting assembly 12 can only engage one coin at a time, no matter how fast or slow the rotating disc 32 may be turning at the moment the coin is engaged, the coins are counted individually even if one coin may subsequently collide, catch up with or overtake another during flight in the area of the coin catching device 76. Because of this close positioning of the sensors 78 to the coin-sorting assemblies 12, the initial travel of a coin along its flight path must be very smooth and predictable. If the coin-sorting wheel or other means used to free the coin from the peripheral rim 60 of the rotating disc 32 causes the coin to wobble, flip over, or turn in flight just after it is depressed and before it is clear of the sensor 78, it may strike the sensor or avoid passing through its sensing light beam.

The design of the coin-sorting wheel 74 of the present invention has proven to be particularly effective in this regard and to produce a smooth and predictable initial coin flight. The sides 118 of the wheel disc 112 have a relatively flat profile, at least in the area adjacent to the rim 116 of the wheel disc, which is believed to account for the improved performance. When the coin being depressed by the wheel disc 112 slides from beneath the wheel rim 116 under the influence of the centrifugal force as it is being hurled from the rotating disc 32, the edge of the coin being pressed into the resilient pad 62 is kicked upward by the resiliency of the pad. With the flat sides 118 of the wheel disc 112, the edge of the coin passes clear of and does not strike the side of the wheel disc. Not only does this contribute to the smoothness and predictability of the initial portion of the flight path, the remainder of the flight path is also smoother and more predictable, consequently helping to solve the problem of design and positioning of the coin-catching devices 76 to catch all coins which are hurled from the rotating disc 32 and reduce interference resulting from coins ricocheting within the coin-catching device once caught.

It will be appreciated that, although a specific embodiment of the invention has been described herein for purposes of illustration, various modifications may be made without departing from the spirit and scope of the invention. Accordingly, the invention is not limited except as by the appended claims.

We claim:

1. A coin-engaging apparatus for use with a coin-sorting machine having a rotating flexible surface, comprising:

a cylindrical shaft positionable within a generally horizontally oriented cylindrical opening of said machine sized to receive said shaft therein, said opening having an open end and a closed end, said shaft being rotatably and horizontally positionable within said opening, said shaft having an eccentric, longitudinal threaded first bore at an end positionable toward said open end of said opening, and having a longitudinal threaded second bore at another end positionable toward said closed end of said opening;

a coin-depressing wheel rotatably mounted along its axis of rotation on a threaded first member, said first member being threadedly engageable by said eccentric first bore for positioning said wheel above said surface;

a threaded second member being threadedly engageable by said threaded second bore and adjustably extendable from said second bore for engaging said closed end of said opening; and means for locking said shaft in a selected rotational position within said opening; whereby adjustment of said second member adjusts the horizontal position of said wheel relative to said surface and adjustment of said rotational position of said shaft within said opening adjusts the vertical position of said wheel relative to said surface.

2. The coin-engaging apparatus of claim 1 wherein said coin-depressing wheel has at least one substantially flat sidewall extending to a coin-contacting circumferential edge wall, said sidewall being positionable toward the coin being engaged.

3. The coin-engaging apparatus of claim 2 wherein said coin-depressing wheel has two oppositely disposed, substantially flat sidewalls to provide a reversible wheel, whereby wheel operating life is effectively doubled.

4. The coin-engaging apparatus of claim 3 wherein said coin-depressing wheel includes a hub rotatably supportable by said first member, and said two oppositely disposed sidewalls are symmetrically positioned along said hub.

5. The coin-engaging apparatus of claim 3 wherein said two oppositely disposed sidewalls terminate radially outward of the axis of rotation of said coin-depressing wheel to define said coin-contacting edge wall therebetween, said edge wall having substantially square edges.

6. The coin-engaging apparatus of claim 1 wherein said first member is a shoulder screw having a circumferential bearing surface for rotatably supporting said coin-depressing wheel.

7. The coin-engaging apparatus of claim 1 wherein said coin-depressing wheel is a disc having a pair of substantially flat radial sidewalls and a peripheral coin-contacting rim, said disc being symmetrically mounted on a hub.

8. A coin-engaging apparatus for use with a coin-sorting machine having a rotatable flexible surface, comprising:

an elongated support member mountable substantially coaxially within a generally horizontally oriented elongated receiver opening of said machine, said support member being rotatably and axially positionable within said receiver opening, said support member having an end portion extending outward beyond said receiver opening rotatably supporting a coin-engaging wheel for rotation about an axis eccentric with said support member, said coin-engaging wheel being positionable above said surface for engaging coins carried thereon; and means for lockably retaining the position of said support member within said receiver opening during operation of said machine.

9. The coin-engaging apparatus of claim 8 wherein said support member has a longitudinal, selectively extendable member projectable from an end of said support member mountable within said receiver opening for engaging an internal end wall of said receiver opening for adjustably setting the limit of horizontally inward movement of said support member in said receiver.

10. The coin-engaging apparatus of claim 9 wherein said extendable member is threaded to threadably engage threads of said support member.

11. The coin-engaging apparatus of claim 8 wherein said support member has a first shaft positionable within said receiver, said first shaft having an eccentric second shaft extending from one end of said first shaft for rotatably supporting said coin-engaging wheel.

12. The coin-engaging apparatus of claim 11 wherein said second shaft is detachable from said first shaft for removal of said coin-engaging wheel.

13. The coin-engaging apparatus of claim 12 wherein said second shaft is a threaded shoulder screw having a circumferential bearing surface for rotatably supporting said coin-engaging wheel.

14. The coin-engaging apparatus of claim 11 wherein said coin-engaging wheel has at least one substantially flat sidewall extending to a coin-contacting circumferential sidewall, said sidewall being positionable toward the coin being engaged.

15. The coin-engaging apparatus of claim 14 wherein said coin-engaging wheel has two oppositely disposed, substantially flat sidewalls to provide a reversible wheel, whereby wheel operating life is effectively doubled.

16. The coin-engaging apparatus of claim 15 wherein said coin-engaging wheel includes a hub rotatably supportable by said first member, and said two oppositely disposed sidewalls are symmetrically positioned along said hub.

17. The coin-engaging apparatus of claim 16 wherein said two oppositely disposed sidewalls terminate radially outward of the axis of rotation of said coin-engaging wheel to define a coin-contacting edge wall therebetween, said edge wall having substantially square edges.

18. The coin-engaging apparatus of claim 11 wherein said coin-engaging wheel is a disc having a pair of substantially flat radial sidewalls and a peripheral coin-contacting rim, said disc being symmetrically mounted on a hub.

19. The coin-engaging apparatus of claim 8 wherein said support member is axially slidable within said receiver opening for horizontal positioning of said coin-engaging wheel.

20. A coin-engaging apparatus for use with a coin-sorting machine having a rotatable flexible surface, comprising:

a support member mountable within a generally horizontally oriented receiver of said machine, said support member being rotatably and horizontally positionable within said receiver, said support member rotatably supporting a coin-engaging wheel for rotation about an axis eccentric with said support member, said coin-engaging wheel being positionable above said surface for engaging coins carrier thereon, said support member having a first shaft positionable within said receiver, said first shaft having an eccentric second shaft extending from one end of said first shaft for rotatably supporting said coin-engaging wheel; and means for lockably retaining the position of said support member within said receiver during operaing of said machine.

21. The coin-engaging apparatus of claim 20 wherein said second shaft is detachable from said first shaft for removal of said coin-engaging wheel.

22. The coin-engaging apparatus of claim 21 wherein said second shaft is a threaded shoulder screw having a circumferential bearing surface for rotatably supporting said coin-engaging wheel.

23. The coin-engaging apparatus of claim 20 wherein said coin-engaging wheel has at least one substantially flat sidewall extending to a coin-contacting circumferential sidewall, said sidewall being positionable toward the coin being engaged.

24. The coin-engaging apparatus of claim 23 wherein said coin-engaging wheel has two oppositely disposed, substantially flat sidewalls to provide a reversible wheel, whereby wheel operating life is effectively doubled.

25. The coin-engaging apparatus of claim 24 wherein said coin-engaging wheel includes a hub rotatably supportable by said first member, and said two oppositely disposed sidewalls are symmetrically positioned along said hub.

26. The coin-engaging apparatus of claim of 25 wherein said two oppositely disposed sidewalls terminate radially outward of the axis of rotation of said coin-engaging wheel to define a coin-contacting edge wall therebetween, said edge wall having substantially square edges.

27. The coin-engaging apparatus of claim 20 wherein said coin-engaging wheel is a disc having a pair of substantially flat radial sidewalls and a peripheral coin-contacting rim, said disc being symmetrically mounted on a hub.

28. A coin-sorting machine for sorting coins of varying diameter, comprising:

guide means for guiding said coins to provide a single-layer, single-file queue of coins;

a rotatably flexible surface on which said queue is formed along a peripheral limit;

a plurality of coin-engaging wheels positioned along said peripheral limit and above said surface for pressing selected coins of said queue into said surface;

an eleongated support member mountable substantially coaxially within a generally horizontally oriented elongated receiver opening, said support member being rotatably and axially positionable within said receiving opening, each said support member having an end portion extending outward beyond said receiver opening in a direction generally toward said peripheral limit and rotatably supporting one of said coin-engaging wheels for rotation about an axis eccentric with said support member, selective rotational positioning of said support member within said receiver opening providing vertical camming movement of said coin-engaging wheels for vertical positioning of said coin-engaging wheels relative to said surface, and selective axial positioning of said support member within said receiver opening providing horizontal movement of said coin-engaging wheels for horizontal positioning of said coin-engaging wheels relative to said peripheral limit; and means for selectively locking said support members in position within said receiver opening during operation of the machine to maintain the selected vertical and horizontal positioning of said coin-engaging wheels relative to said surface and said peripheral limit, respectively.

29. The coin-sorting machine of claim 28, further including coin counting means positioned adjacent to each of said coin-engaging wheels for counting coins as they are sorted by said coin-engaging wheels.

* * * * *